United States Patent [19]

Edwards et al.

[11] 4,224,117

[45] Sep. 23, 1980

[54] METHODS OF AND APPARATUS FOR SELECTIVE PLATING

[75] Inventors: Monty J. Edwards, Chamblee; James E. Voytko, Doraville, both of Ga.

[73] Assignee: Western Electric Company, Inc., New York, N.Y.

[21] Appl. No.: 30,985

[22] Filed: Apr. 18, 1979

Related U.S. Application Data

[63] Continuation-in-part of Ser. No. 865,569, Dec. 29, 1977, abandoned.

[51] Int. Cl.[2] ..... C25D 5/02; C25D 5/08; C25D 7/06

[52] U.S. Cl. ..... 204/15; 204/28; 204/206; 204/224 R

[58] Field of Search ..... 204/15, 224 R, 28, 206

[56] References Cited

U.S. PATENT DOCUMENTS

| | | | |
|---|---|---|---|
| 2,974,097 | 3/1961 | Ramirez et al. | 204/206 |
| 3,470,081 | 9/1969 | Lovekin | 204/206 |
| 3,644,181 | 2/1972 | Donaldson | 204/224 R |
| 3,723,283 | 3/1973 | Johnson | 204/206 |
| 3,788,963 | 1/1974 | Kosowsky | 204/206 |
| 3,894,918 | 7/1975 | Corby | 204/15 |
| 3,962,063 | 6/1976 | Hingorany | 204/206 |
| 3,963,569 | 6/1976 | Toledo | 204/206 |
| 4,029,555 | 6/1977 | Tezuka | 204/15 |
| 4,030,999 | 6/1977 | Allen | 204/224 R |
| 4,033,832 | 7/1977 | Sterling | 204/15 |
| 4,033,833 | 7/1977 | Bestel | 204/15 |
| 4,048,043 | 9/1977 | Bick | 204/224 R |
| 4,069,126 | 1/1978 | Abei | 204/224 R |

FOREIGN PATENT DOCUMENTS 1396342 6/1975 United Kingdom .

*Primary Examiner*—T. M. Tufariello
*Attorney, Agent, or Firm*—E. W. Somers; J. B. Hoofnagle, Jr.

[57] ABSTRACT

Selected, relatively inaccessible, areas of surfaces (28) which define openings (21) that extend through a strip, which is being advanced at a relatively high velocity along a path through a closed plating cell, are electroplated with a minimum required thickness of metal. The strip (11) is cathodically charged and is masked along a portion of a path to expose at least the surfaces which define the openings. A flow passage for an electroplating electrolyte (41) is established from a source (42) past a charged anode (101) in a direction through the openings (21) and includes a linear portion extending substantially normal to the strip on each side thereof. The anode extends along the portion of the path, parallel to and spaced from the strip (11), and focused on the areas to be plated. The charged anode (101) and the exposed areas of surfaces of the strip (11) are contacted with the electrolyte (41) to charge the electrolyte and pass an electric current therethrough to plate the exposed areas of the surfaces.

12 Claims, 9 Drawing Figures

METHODS OF AND APPARATUS FOR SELECTIVE PLATING

CROSS REFERENCE TO RELATED APPLICATION

This is a continuation-in-part of application Ser. No. 865,569 filed Dec. 29, 1977 abandoned.

TECHNICAL FIELD

This invention relates to methods of and apparatus for selective plating and more particularly, to methods of and apparatus for plating conductor-engagement surfaces which are spaced along and extend normal to the plane of a strip that is being advanced continuously at a relatively high velocity through a closed plating cell in which a flowing electrolyte has a relatively high turnover.

BACKGROUND OF THE INVENTION

In order electrically to interconnect insulated conductors in certain kinds of environments such as, for example, in splice cases or in telephone central offices, slotted beam connectors are used. These connectors, commonly known as contact elements, have a central body with beams extending bilaterally therefrom. Each beam is bifurcated with the furcations of each beam being spaced apart to define a conductor-receiving slot having predetermined width characteristics. See, for example, U.S. Pat. No. 4,136,628 issued Jan. 30, 1979 in the names of Charles McGonigal and James Emery Voytko.

A connection between two insulated conductors is made by the insertion of one of the conductors into the slot in one of the beams and the other conductor into the slot in the other one of the beams. As this is done, portions of the connector which define flared entrances to the slots slice through the insulation and cause an electrical connection to be established between the contact element and the conductor.

Corrosion at the interface of the conductor and the walls of the beam which define the conductor-receiving slots is prevented by a resistant material which is plated on those walls, but a problem arises because an average width of each of the conductor-receiving slots may be on the order of only several mils, and a specified minimum plating thickness is required on the walls which define each slot. Because they are not well exposed to an electroplating electrolyte and an electric field when using conventional plating methods, the surfaces which define a conductor-receiving slot are commonly said to be less significant surfaces or low current density areas compared to significant surfaces or high current density areas such as flat, parallel major surfaces of the contact element. Inasmuch as the slot width is relatively small, excessive plating on other surfaces may ensue, particularly on ends of the beam, if conventional techniques in which a strip is indexed into a plating station, masked and plated are used to achieve the minimum thickness required on the slot walls.

It is not required nor is it desirable to plate some surface areas of the contact elements, such as for example, the ends of the beam which define entrance portions of the slots since the conductors engage those walls only temporarily as they are used to slice through or otherwise penetrate the conductor insulation. While soft metals such as, for example, solder, are especially suitable for the extablishment of electrical contact with a conductor, their use as the plating metal inhibits insulation penetration and may prevent the establishment of electrical contact between the slot walls and the conductor. Also, the unwanted deposition of plating material on the flat, parallel surfaces of the contact element causes a problem during manufacture as the strip of metal is indexed through and formed partially at each of a plurality of work stations as well as in subsequent operations where the element is assembled into a connector unit. Soft plated materials tend to adhere to portions of work tools at each station as the tools are moved out of engagement with flat surfaces of the strip thus impairing the indexing of the strip and increasing tool maintenance.

In U.S. Pat. No. 4,033,833 issued July 5, 1977 in the names of J. L. Bestel et al, an anode is contact-masked with a dielectric member to shield the anode from a spaced, charged surface after which electroplating electrolyte is distributed over at least the area to be electroplated. The prior art also includes U.S. Pat. No. 2,974,097 in which a strip is advanced between spaced ribs that cooperate to seal a center portion of the strip from a longitudinal edge of the strip which together with an anode protrude from opposite walls into a chamber which is filled with an electrolyte. Other prior art arrangements are shown in U.S. Pat. Nos. 3,470,081, 3,723,283, 3,962,063, 4,033,832 and 4,048,043.

It is also desirable in continuous strip plating to be able to advance the strip at a relatively high speed and to contact it with an electrolyte having a relatively high turnover. Moreover, the parameters which affect the flowing electrolyte should be capable of being controlled independently of the ratio of surface area of the anode and the exposed portions of the strip. The prior art includes Tezuka et al U.S. Pat. No. 4,029,555, but it includes a nozzle anode which does not allow independent control of parameters and also employs an angled flow passage which results in cavitation.

These prior art arrangements are not satisfactory for the plating of the cnductor-receiving slot walls which extend between the parallel major surfaces of a continuously moving strip of contact elements. What is needed and what the prior art lacks is a mask and anode arrangement and an electrolyte flow pattern in which the slot walls of the bifurcated beams are converted from less significant to more significant surfaces so that a minimum plating thickness of the slot walls is achieved without the deposition of an excessively thick plating on other functional or non-functional surfaces. A plating arrangement which overcomes the problems of the prior art should also be one which is capable of plating the slot walls with a metal which is not only electrically conductive but one which is also capable of penetrating any one of a number of commonly used conductor insulation materials.

SUMMARY OF THE INVENTION

The foregoing problems and inadequacies of the prior art of selective plating are overcome by this invention in which a masking arrangement of portions of a continuously advancing strip cooperates with a controlled flow electrolyte and a focused anode to plate effectively generally inaccessible surfaces of the strip.

A method of plating selected areas of surfaces of a strip in accordance with this invention includes the step of continuously advancing a strip along a path, said strip having two major surfaces and openings which extend between the major surfaces, and cathodically charging the strip. Longitudinally extending portions of the strip are masked along a portion of the path to expose selected areas of surfaces of the strip including at least those surfaces which define the openings that extend through the strip. A substantially enclosed flow passage for an electroplating electrolyte is established from a source into engagement with and past the exposed areas of the strip along the portion of the path in a direction through the openings in the strip with the flow passage including a linear portion extending substantially normal to the strip from each major surface. A charged anode which has an effective area in a predetermined ratio to the areas to be plated and which is focused with respect to those areas is positioned in a linear portion of the flow passage adjacent at least one major surface of and extends parallel to the strip along the portion of the path. The charged anode and the exposed areas of the charged strip are contacted with the electrolyte to charge the electrolyte and pass an electric current therethrough to plate the exposed areas of the strip. The ratio of the surface areas is capable of being controlled independently of the parameters which affect the pressure and velocity of the flowing electrolyte.

An apparatus for plating selected areas of surfaces of a strip includes facilities for continuously advancing a strip along a path, the strip having openings which extend through the strip between major surfaces thereof, and facilities for cathodically charging the strip to a first potential. Facilities are provided along a portion of the length of the path for masking the strip to expose only selected areas of surfaces of the strip, which includes at least those surfaces which define the openings. The apparatus includes facilities along the portion of the path for establishing a substantially enclosed flow passage for directing an electroplating electrolyte into engagement with and past the exposed areas of the strip in a direction through the openings, said flow passage including a linear portion extending substantially normal to each major surface of the strip. An anode which is charged to a second potential is positioned in the flow path, spaced from the exposed areas of the strip adjacent at least one major surface, and extends parallel to the strip along the portion of the path. Facilities are provided for contacting the charged anode and the exposed areas of the charged strip with the electrolyte to charge the electrolyte and pass an electric current therethrough to electroplate the exposed areas of the strip.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
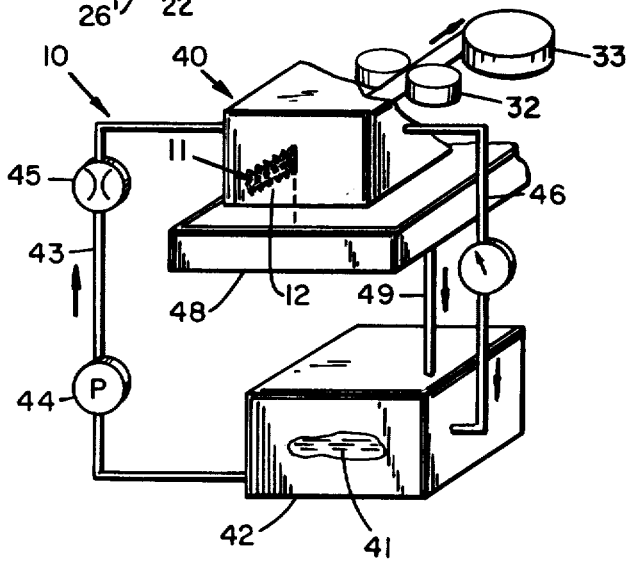
FIG. 1 is a schematic view of an apparatus which is constructed in accordance with this invention for selectively plating a continuously advancing strip.

Referring now to FIG. 1, there is shown an apparatus, designated generally by the numeral 10, for plating selected portions of a strip 11 of metal which is being continuously advanced along a manufacturing line. The strip 11, which includes a plurality of interconnected, completely formed contact elements 12—12, is generally made of a metal such as, for example, Phosphor-bronze alloy. It should be understood that this invention is also applicable to a strip of interconnected partially formed contact elements.

Each of the contact elements 12—12 (see FIG. 2) in its final configuration prior to its separation from the strip 11 includes a central base portion 16 having a pair of oppositely extending beams 17—17' which are bifurcated to form furcations 18—18 and 18'—18'. The bifurcated portion of each beam 17—17' communicates with an elongated slot 19—19' which is adjacent the central base portion 16. The furcations 18—18 and 18'—18' of the beams 17—17' are spaced apart to form conductor-receiving slots 21—21' having predetermined width characteristics and communicating with angled entrance portions 22—22' and with the associated elongated slots 19—19'.

In the use of a contact element 12, a plurality of which are typically mounted in an array in a block made of a dielectric material such as is shown, for example, in U.S. Pat. No. 3,858,158 which issued Dec. 31, 1974 in the names of Robert W. Henn et al, an insulated conductor 24 is moved into the conductor-receiving slot 21', for example. As this is done, edge surfaces 26'-26' of the angled entrance portion 22' slice through an insulative covering 27 to establish electrical contact with the conductor 24. The insulated conductor 24 is then moved into the conductor-receiving slot 21' where it remains during use.

The plating of the contact element 12 is selective in order to conserve materials and in order to meet the functional requirements of the contact element. The surfaces 26-26 and 26'-26' of the entrance portions 22-22' need not be plated and in fact they desirably are not plated in order to insure that they slice through the insulation 27 of a conductor 24 to establish electrical contact therewith. On the other hand, opposing surfaces 28—28 and 28'—28' of the furcations 18—18 and 18'—18', respectively, which define the slots 21—21' are plated with a predetermined thickness of metal which maximizes corrosion protection and which minimizes contact resistance of the opposing slot surfaces with conductors 24—24.

The strip 11 of partially formed contact elements 12—12 is advanced continuously from a supply roll (not shown) through the apparatus 10 by a capstan 32 and taken up on a reel 33. It should be understood that the strip 11 of metal which is advanced through apparatus (not shown) may be formed into the interconnected contact elements 12—12 on the same line prior to the advancement of the strip through the apparatus 10. In one such arrangement as disclosed and claimed in priorly identified U.S. Pat. 4,136,628, openings are first formed in the strip 11 after which the walls of the openings are plated by advancing the strip through the apparatus 10. Subsequently, furcations are formed in the strip 11 to encompass each of the openings and then the furcations are moved toward each other to form a conductor-receiving slot 21 having predetermined width characteristics.

Figure 3:
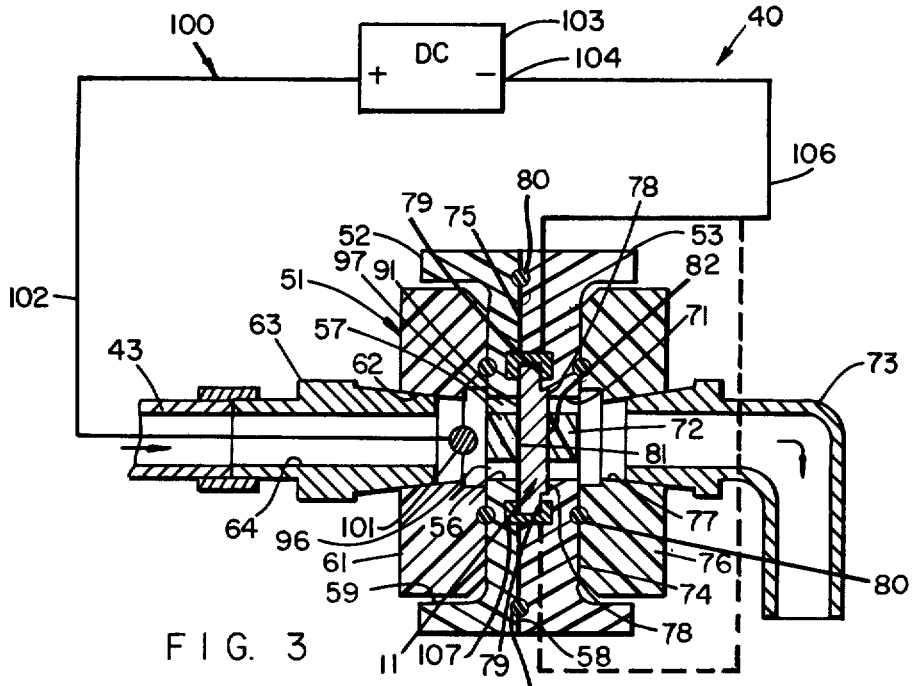
FIG. 3 is an enlarged view in section of a portion of the apparatus of FIG. 1 which includes a plating cell with the strip being shown in a position normal to a flow passage for an electroplating electrolyte.

The apparatus 10 as depicted generally in FIG. 1 includes a closed plating cell, designated generally by the numeral 40, which is supplied with an electroplating electrolyte 41 from a reservoir 42. The electrolyte 41 is moved by a pump 44 from the reservoir 42 through a conduit 43, and through a flow controller 45 to the cell 40 with unused portions of the electrolyte being returned to the reservoir along a conduit 46. Any of the electrolyte 40 which escapes from the cell 41 is caught by a container 48 and returned along a line 49 to the reservoir 42. As can be seen in FIG. 3, the plating cell 40 comprises a closed system which prevents exposure of the electrolyte 41, for example, to the deleterious effects of the atmosphere and which reduces oxidation of the metal in the electrolyte.

Referring now to FIG. 3 of the drawings, it can be seen that the closed plating cell 40 includes a housing, designated generally by the numeral 51, which comprises longitudinally extending, separable portions 52 and 53. The portion 52 includes a longitudinally extending, centrally disposed opening 56 in which is positioned a mask 57. The opening 56 in the portion 52 communicates between a surface 58 and a well 59 for supporting a removably mounted insert 61 that has an opening 62 for receiving an adapter 63 having a passageway 64 that connects the conduit 43 to the cell 40. The other portion 53 of the housing 51 includes a longitudinally extending, centrally disposed opening 71 in which is positioned a mask 72. The opening 71 in the portion 53 communicates with a well 74 for holding a removably mounted insert 76 that has an opening 77 therein for receiving an adapter 73 that is connected to the electrolyte return conduit 46. The opening 71 also communicates with a surface 75 of the portion 53 through a stepped opening which is formed by longitudinally extending ledges 78—78 and 79—79. Longitudinally extending seals 80—80 are positioned between the inserts 61 and 76 and the portions 52 and 53 of the housing 51 to prevent leakage of the electrolyte 41 and to provide for a pressure drawdown of the inserts in engagement with the portions.

The housing 51 and the inserts 61 and 76 are constructed of an electrical insulating material which is not adversely affected by the electrolyte, such as, for example, polyvinyl chloride or polypropylene. Moreover, it should be understood that the inserts 61 and 76 are removable and interchangeable with inserts having other configurations for masking strips having different selected areas which are to be plated.

It should be observed from FIG. 3 that the housing 51 is assembled with portions of the surfaces 58 and 75 being contiguous and with a surface 81 of the mask 57 being in the same plane therewith. However, the mask 72 is positioned so that a surface 82 thereof is spaced slightly, e.g. several mils, from the surface 81 of the mask 57 to permit the movement of the strip 11 through the closed cell 40.

Figure 2:
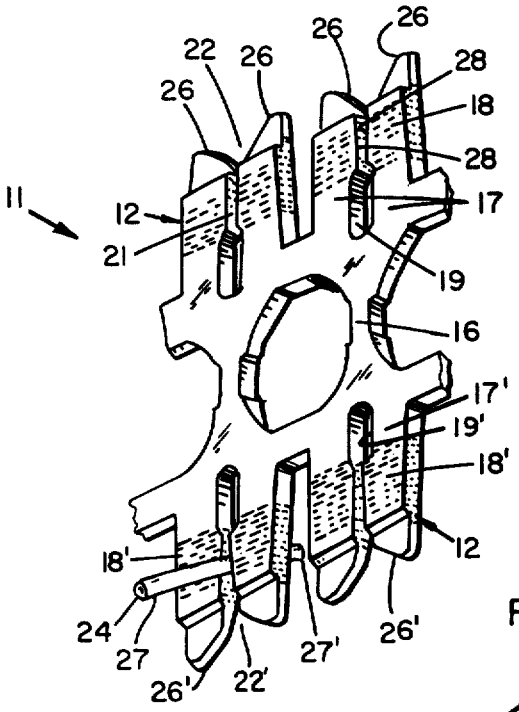
FIG. 2 is a perspective view of a portion of a strip of contact elements, with one of the contact elements separated from the strip, and with selected portions of each contact element having been plated with the apparatus of FIG. 1.
Figure 3A:
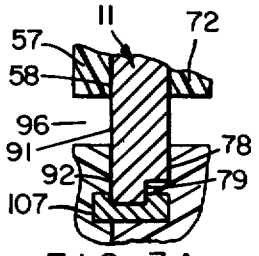
FIG. 3A is an enlarged view in elevation of a portion of the cell of FIG. 3 and showing details of the strip with respect to the cell.

The mask portions 57 and 72 cooperate to define therebetween a passageway 91 (see FIG. 3A) through which the strip 11 is advanced. The ledges 78—78 and 79—79 cooperate with the surface 58 to form openings 92—92 through which the longitudinal edges of the strip 11, are advanced. As can be seen in FIG. 2, the portions of each of the contact elements 12—12 which include the entrance surfaces 26—26' are formed along the longitudinal edges of the strip 11 and have a thickness which is less than the portions in which the slots 21—21 are formed. The reduced thickness portions engage the surface 58 of the portion 52 and the ledges 79—79 while the outermost portions of the furcations 18—18' which form the slots 21—21' are in engagement with the ledges 78—78 as the strip 11 is moved through the cell 40.

As a result of the masks 57 and 72, two longitudinally extending apertures 96 and 97 are formed in the cell 40. These apertures 96 and 97 expose selected portions of the strip 11 as the strip is moved through the cell 40. The selected portions of the contact elements 12—12 which are exposed are cross-hatched with broken lines in FIG. 2 and include the portions of the furcations 18—18 which are adjacent the conductor-receiving slots 21—21.

As can best be seen in FIG. 3 a linear flow passage for the electrolyte is established in a manner to provide a relatively high turnover of the electrolyte which contacts the strip resulting in an extremely efficient plating process. The flow passage includes a linear portion 98 in the conduit 43 an adapter 63, a linear portion 99 in the adapter 73, and the apertures 96 and 97, and the slots 21 and 21' through the strip 11. In this arrangement, the substantially linear portions 78 and 79 on each side of the strip 11 and the complete filling of the flow passage with the electroplating electrolyte during the plating operation prevents cavitation of portions of the apparatus. The linear flow passage includes an entry end at the portion 98 and an exit end at the portion 99.

Figure 4:
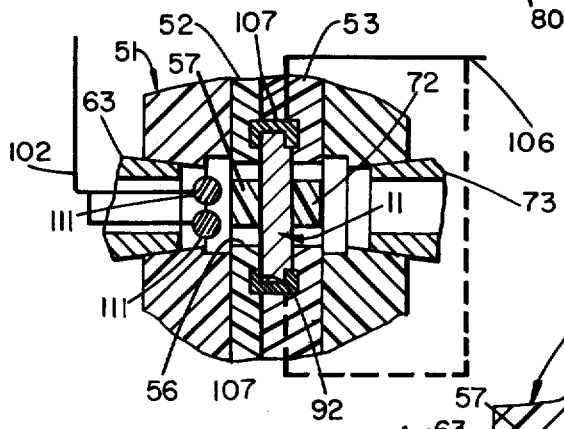
FIG. 4 is a detailed view of a portion of the plating cell shown in FIG. 3 and showing another arrangement of anodes.
Figure 5:
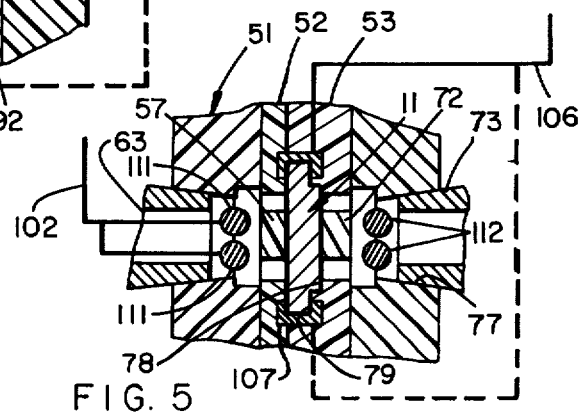
FIG. 5 is a schematic view of a portion of the plating cell of FIG. 3 and showing still another anode arrangement.

Still referring now to FIG. 3, there is shown a plating circuit, designated generally by the numeral 100, which comprises part of the plating cell 40. The plating circuit 100 includes a longitudinally extending anode 101, which is connected along a line 102 to the positive side of a D.C. power supply 103. A negative terminal 104 of the power supply 103 is connected along a line 106 to a pair of brushes 107—107 which are spaced apart and mounted in the housing 51 to engage longitudinal edge portions of the strip 11 as it is advanced through the housing to cathodically charge the strip to a desired potential. It should be understood that the brushes 107—107 may be located external to the housing 51 for providing cathodic contact in which case, the brushes as shown in FIGS. 3-5 would be replaced with additional dielectric material for masking.

FIG. 3 also discloses the positioning of the anode 101 with respect to the strip 11 and the apertured masks 57 and 72. A single anode 101 is shown and is mounted in such a way that it is aligned with the longitudinal centerline of the strip 11 between the mask 57 and the adapter 63. The anode 101 in a preferred embodiment is made from a non-corrosive conductive material which is selected so as to be insoluble with respect to the particular electrolyte which is used in the plating process. For example, when tin-lead-fluoroborate is used as the electrolyte, the anode 101 is made from a Carpenter 20 alloy which is a high nickel, chromium, stainless steel alloy.

The positioning of the anode 101, as shown in FIG. 3, in the flow path of the electrolyte 41 in general alignment with the strip 11 and shielded by the dielectric causes an electric plating field to be focused on unmasked surface areas of the strip. It is for this reason that this arrangement is referred to as a "focused anode" arrangement which is effective, unlike prior art screen electrode arrangements, to concentrate a deposit of metal ions from the electroplating electrolyte on the unmasked areas of the strip 11.

Not only does the anode 101 extend continuously through the closed cell 40, but it is also disposed parallel to the strip 11. This arrangement provides a substantially uniform current density and results in a substantially uniform thickness of plated metal on the selected areas of the strip 11.

While the anode 101 is an insoluble anode, it should be understood that the invention also contemplates the use of a soluble anode. The apparatus 10 is especially suitable for the use of a soluble anode since the mounting arrangement in the flow path of the electrolyte improves the anode dissolution to better remove metal ions, concentrates the electric field and results in a more uniform plating of selected surface areas of the strip 11.

While FIG. 3 shows the single anode 101, multiple anodes may be used when plating the surfaces 28—28 of the conductor-receiving slots 21—21 or surfaces destined to be such. As shown in FIG. 4, another arrangement includes two anodes 111—111 which are mounted between the mask 57 and the adapter 63. Each of the anodes 111—111 is aligned with one of the unmasked portions of the strip 11 which are symmetrical with the longitudinal centerline and which are exposed to the electrolyte. The alignment of an anode 111 with each area to be plated, causes an effective concentration of metal ions to occur.

Still another embodiment of anode placement, which is preferred, is shown in FIG. 5 where anodes 111—111 of FIG. 4 are supplemented with another set of anodes 112—112 on the opposite side of the strip 11. The use of this arrangement increases the anode efficiency and establishes an electric field on both sides of the strip 11 instead of a gradient from one side of the strip only. This is established useful when the apparatus 10 is used to plate surfaces such as 28—28 that extend through a relatively thick strip of metal.

The surface area of an anode in relationship to the surface area of a cathode, which in this invention is the strip 11, is also an important parameter insofar as plating effectiveness is concerned. In the case of solder plating for example, it is generally preferred to have an anodic area which is about twice that of the cathodic area. Since in the arrangement of the apparatus 10, a portion of the cathode or strip 11 has been masked off, the effective area of the anode 101 must be reduced. In order to accomplish this, the anode 101 may be coated with a dielectric material, such as, for example, an epoxy resin, or otherwise masked so that only a linear conducting surface of the anode which is parallel to the path of motion of the strip 11 is exposed. As can be seen in FIG. 3, the anode 101 is easily removable from the cell 40 and may be replaced with another configuration or with one to achieve a particular effective anodic-to-exposed cathodic surface area ratio.

The focused anode arrangement of this invention allows a change in the aforementioned surface area ratio without affecting parameters of the flowing electrolyte. This overcomes a problem with at least one prior art arrangement including a nozzle anode in which a change in the anodic area affects the parameters of the electrolyte flow.

The apparatus 10 is also effective to cause a minimum required thickness plating to be deposited on the walls of each of the conductor-receiving slots 21. This is accomplished notwithstanding the somewhat inferior plating characteristics of the surfaces 28—28 to be plated. In the plating art, surfaces which are well exposed to a plating anode and hence subject to a high current concentration are said to be high current density areas. For example, that major surface of the strip which is more directly exposed to the anode is a high current density area while the major surface of the strip 11 opposite the side which is exposed to the anode 101 and the surfaces 28—28 of the opening are referred to as low current density areas. The surfaces 28—28 which define the conductor-receiving slots 21—21 are not exposed to as high a current as the portions of the flat surfaces of the strip adjacent thereto whereas the sharp edges of the conductor-receiving slots and the flared entrance portions 22—22' are high-current density areas.

In order to be able to selectively plate in this manner, the high density areas of the strip 11 are masked while at the same time, the anode 111 is focused on the low current density areas, i.e. the surfaces 28—28, which are to be plated. In effect, the otherwise high current density, more significant, areas are made less significant than those which are to be plated. Of course, if an anode in the form of a wire were inserted thorugh an opening to be plated, then the walls of the opening would be the significant area; however, such an arrangement for the selective plating of a continuously advanced strip is not feasible. In many prior art arrangements such as, for example, that disclosed in priorly discussed U.S. Pat. No. 2,974,097, lower current density areas are simply masked off which further emphasizes the high current density areas. The flowing electrolyte insures that there are sufficient metal ions brought into engagement with the surface to be plated.

Two other parameters, the velocity and pressure of the electroplating electrolyte which is flowed past the strip 11, are also important to the control of and to the effectiveness of the plating operation. If the pressure is too low, only the major surface of the strip 11 which faces the anode 111 and those surfaces of the contact elements 12—12 which are normal to the parallel major surfaces and which are well exposed, such as for example, the outside edge surfaces of the furcations 18—18, will be plated. The pressure of the electrolyte must be sufficiently high to cause it to flow through the conductor-receiving slots 21—21 to plate those surfaces which, of course, will also result in a plating of the unmasked external edge surfaces. However, it has been found that with this arrangement, the plating thickness on surfaces other than the slot walls and the outside edge surfaces is held to a minimum. In a preferred embodiment, the pressure of the electrolyte is in a range of 3.5 to 27.6 kPa (kilopascals) while it is advanced at a velocity in a range of 6.0 to 8.01/m (liters/minute).

The pressure and the velocity of the electrolyte are also adjustable relative to the speed with which the strip 11 is advanced. Typically, the strip 11 is advanced at a speed which falls in a range of 0.03 to 0.06 m/s (meters/second). However, instead of adjusting the pressure and the velocity of the electrolyte 41 when the speed is changed, it may be preferable to change the length of the cell 40. For example, if it desired to double the speed at which the strip 11 is advanced, then the length of the plating cell 40, which is about 61 cm for a strip speed of 0.03 to 0.06 m/s, should be doubled.

It is also important to recognize that the velocity and pressure of the electrolyte can be controlled independently of the control of the anodic-to-surface area ratio. This is unlike the hereinbefore-described prior art arrangement in which nozzle anodes are used and in which a change in area ratio necessarily change the pressure-velocity parameters of the flowing electrolyte.

The closed cell arrangement of this invention provides at least several important benefits and facilitates the relatively high speed plating of the areas which define the openings. In commonplace jet or spray plating arrangements, aeration occurs and only a limited current density can be realized whereas in the cell 40 there is no aeration and high current densities, which are on an order of magnitude of ten times as much as the commonplace arrangements, can be realized and maintained. The closed cell 40 also allows the use of a constant volume of flow of the electrolyte at a relatively high pressure with the result that the areas that define the openings are plated notwithstanding a reasonable increase in the rate at which the strip is advanced through the cell.

The closed cell arrangement of this invention also helps to overcome the problem in which the electrolyte adjacent the strip 11 is depleted of metal ions during the process. Because of the ability to use increased velocities and pressures, the rate of electrolyte solution turnover is increased thereby resulting in an increased rate of replenishment of the depletion layer. The rapid rate of replenishment together with the configuration of the flow passage prevents cavitation of any of the elements of the cell 40.

The closed cell 40 also permits the removal of the anode 96 or anodes 111—111 and 112—112 and their replacement in the event of wear or in order to provide a different surface area ratio.

Figure 6:
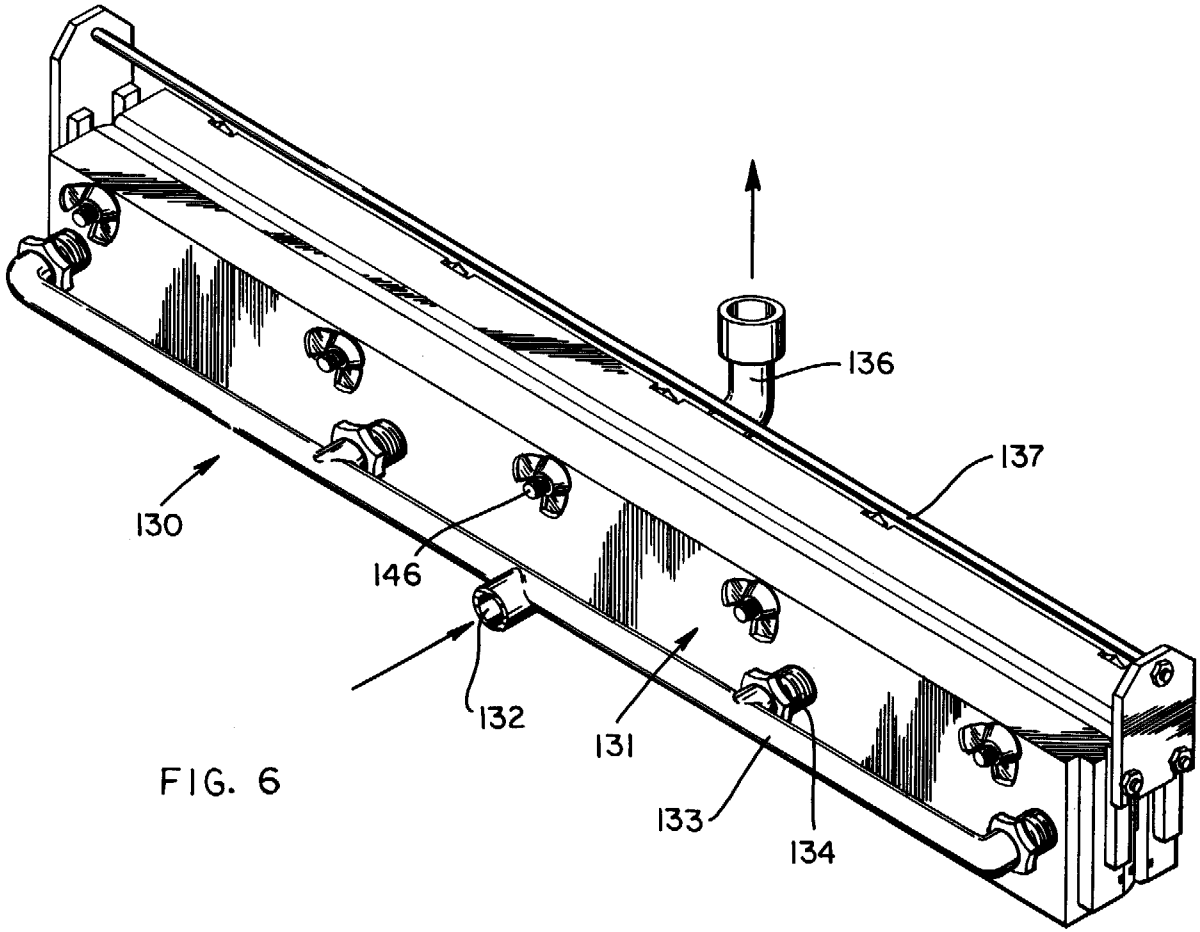
FIG. 6 is a perspective view of a preferred embodiment of apparatus in accordance with the invention and including the anode arrangement shown in FIG. 5.
Figure 7:
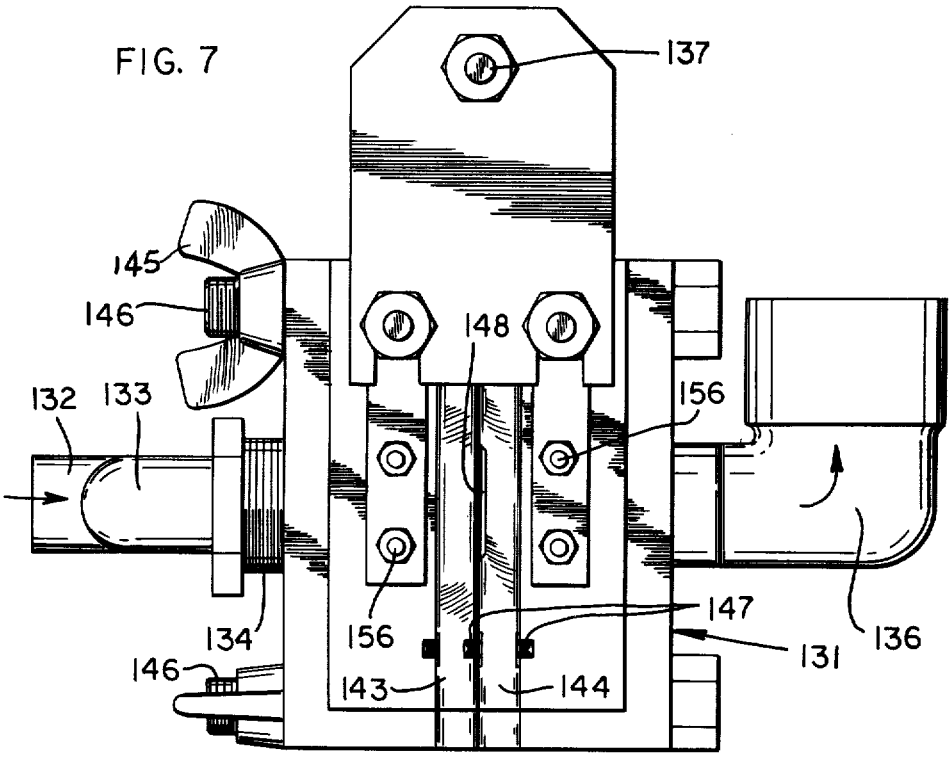
FIG. 7 is an end view of the closed cell plating apparatus of FIG. 6.
Figure 8:
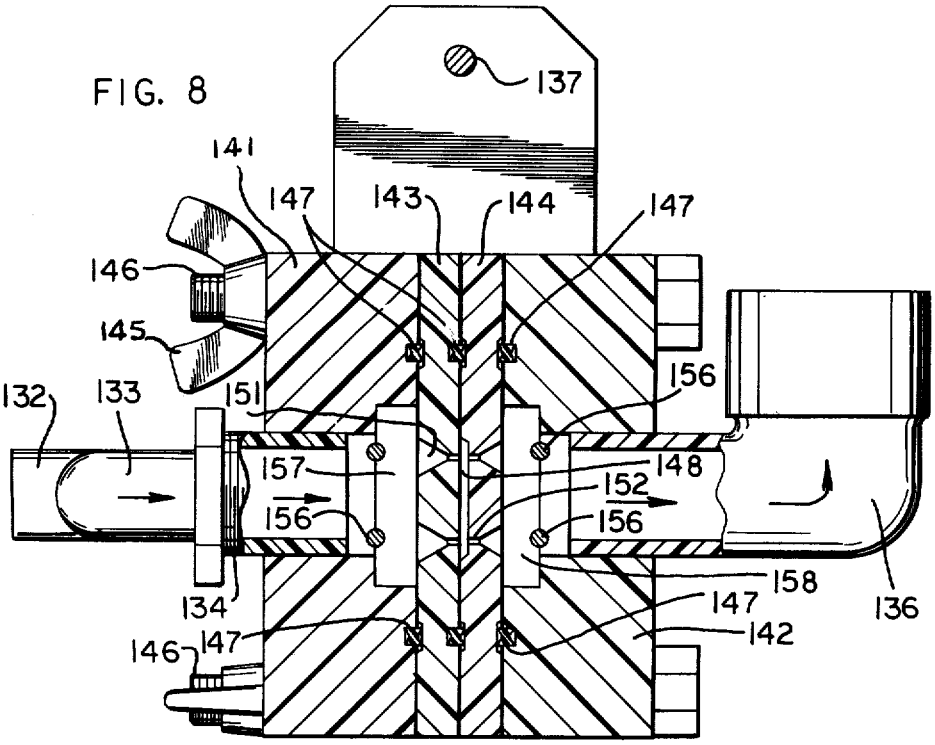
FIG. 8 is an end view in section of the closed cell plating apparatus of FIG. 6.

A still further embodiment of the invention which is shown in FIGS. 6–8 is especially illustrative of the closed cell feature of the apparatus in accordance with the invention and of the versatility of it in making changes to carry out desired plating programs. As is seen in FIG. 6, a closed cell 130 includes a housing, designated generally by the numeral 131, having a supply port 132 which opens to a manifold 133. From the manifold 133, an electroplating electrolyte is moved through each of a plurality of openings 134—134 into the housing, through the openings in the advancing strip 11 and along a return conduit 136. The housing 131 has a handle 137 attached thereto which facilitates the removal and placement of the closed cell for maintenance as well as movement between different manufacturing locations.

Referring now to FIGS. 7 and 8, the housing 131 comprises a pair of outer members 141 and 142 having a pair of inner members 143 and 144 sandwiched therebetween and held assembled together by a plurality of bolts 146—146 and fasteners 145—145. A plurality of longitudinally extending seals 147—147 are disposed between the inner and outer members 141-142 and 143-144 to prevent leakage of the electroplating electrolyte.

The inner member 144 is made to include a channel 148 along which the strip 11 is advanced through the closed cell 130. Each of the inner members 143 and 144 includes a pair of spaced funnel-shaped flow orifices 151—151 having small diameter portions 152—152 which are aligned with portions of the strip being advanced along the channel 148 that are to be plated. Should it be desired to expose other surfaces of the strip 11 or to plate different patterns of metal thereon, the housing 131 is disassembled by turning the fasteners 145—145 along the bolts 146—146. The inner surfaces 143 and 144 are removed and other inner members having a desired arrangement of flow orifices are reassembled with the outer members 141 and 142.

The closed cell 130 also includes a plurality of anodes 156—156 which are longitudinally extending within a chamber 157 formed in the member 141 and a chamber 158 formed in the member 142. As can be seen, each of the anodes 156—156 is aligned with and associated with one of the flow orifices 151—151 so that the anode is focused with respect to an area of the strip to be plated.

As in the other embodiments shown in the drawings, the anodes 156—156 extend continuously through the housing 131 and are disposed parallel to the strip 11 to be plated. This it will be recalled facilitates a substantially uniform current density and results in a substantially uniform thickness of plated metal on the exposed areas. Advantageously, the end attachments of the handle 137 to the housing 131 interconnects the ends of the anodes 156—156.

It should be apparent that while the flow orifices 151—151 in this embodiment are continuous through the length of the housing 131, they could be replaced with two spaced rows each comprising a plurality of openings to provide a changed, segmented plating pattern.

In operation, the pump 44 is activated to produce a continuous flowing stream of the electrolyte 41 which is injected through the adapter 63 into the cell 40 (FIG. 1) or into the cell 130 (FIG. 6) where it contacts the anode or anodes which are maintained at a desired potential, e.g. 4 to 6 volts, by the source 103. The electrolyte stream passes through the closed cell and impinges on the exposed surfaces of the cathodically charged strip 11 including the opposed surfaces 28—28 of the conductor-receiving slot 21. An electric plating field is established between the anode or anodes and the surfaces of the strip 11 which are to be plated through the distributed flowing stream of the electroplating electrolyte 41. The stream of the electrolyte which contacts the charged anode or anodes and is distributed over exposed portions of the charged strip 11 becomes charged and a current is passed therethrough whereby a current density is established within the flowing stream of the electrolyte which is sufficient for electroplating to occur on the exposed surfaces of the strip 11.

The masking of the strip 11 controls the flow rate distribution of the distributed flowing stream of electrolyte and localizes the electric plating field to the exposed portions of the surfaces of the strip 11 whereby the plating of a desired thickness profile is obtained thereon. The efficiency of the plating process as well as the thickness of metal which is placed on the strip 11 is dependent on such plating parameters as the electrolyte flow rate, the current density, the anode-to-cathode distance and the electrolyte which is employed.

EXAMPLE

A strip 11 having a width of about 19 mm and a thickness of about 0.8 mm of insulation-penetrating, slotted-beam contact elements was advanced through the plating cell 40 which had a length of 61 cm at a line speed of about 0.02 m/s. An electrolyte which per liter comprised 155 ml of stannous fluroborate (with a concentration of about 50–52% by weight), 53 ml of lead fluroborate (with a concentration of about 57%), 142 ml of fluroboric acid (with a concentration of about 48–50%), 34 grams of boric acid, 30 ml of formaldehyde (with a concentration of about 37%), 40 ml of a metal grain refiner and brightener such as, for example, Kenvert #327 sold by the 3M Company, and the remainder being water, was flowed through the plating cell at a velocity of 7.8 l/m and a pressure of 3.5 kPa to plate a metal layer having a nominal $2.54\times10^{-3}$ mm thickness on the walls of the conductor-receiving slots of the contact elements. The plating circuit 100 included a D.C. power supply 103 such as, for example, one marketed by Hewlett-Packard and designated Power Supply Model No. 6261 B having an operating range of 0–20 volts and 0–50 amperes and operated at 4.5 volts and 12.0 amps. The anode 101 was constructed to be 0.125 mm in diameter with an uncoated area of about 1.2 mm×61 cm to yield an anode current density of 46.0 amps/square decimeter while the unmasked portions of the strip 11 were of such an area that the cathode current density was 35.7 amps/square decimeter. The anode 101 was positioned in the flow passage to be about 9 mm from the strip 11. The resulting thickness of the plated metal on the walls of the conductor-receiving slot was found to be $2.3\times10^{-3}$ mm with a standard deviation of $3.8\times10^{-4}$ mm.

It is to be understood that the above-described arrangements are simply illustrative of the invention. Other arrangements may be devised by those skilled in the art which will embody the principles of this invention and fall within the spirit and scope thereof.

What is claimed is:

1. A method of plating selected areas of surfaces of a strip, which comprises the steps of:

continuously advancing a strip along a path, said strip having two major surfaces and having openings which extend between said major surfaces;

cathodically charging the strip;

masking longitudinally extending portions of the strip along a portion of the path to expose selected areas of surfaces of the strip including at least those surfaces which define the openings;

establishing a substantially enclosed flow passage having an entry end and an exit end for facilitating movement of an electroplating electrolyte from a source into engagement with the exposed areas of the strip along said portion of the path and through the openings in the strip, said flow passage including linear portions extending normal to the strip for a substantial distance from each major surface thereof;

positioning a continuously charged anode in a linear portion of the flow passage adjacent at least one major surface of and extending parallel to the strip along said portion of the path, said anode being focused on the exposed areas of the strip; and flowing all of the electrolyte which enters the entry end of the flow passage continuously in one direction through the linear portion of the flow passage on one side of the strip, past the charged anode and through the openings in the strip, and then along the linear portion on the opposite side of the strip to the exit end of the flow passage to charge the electrolyte and pass an electric current therethrough to electroplate the surfaces which extend in the direction of the flow passage.

2. The method of claim 1, which also includes the step of regulating the pressure and the velocity of the electrolyte in the flow passage to cause the electrolyte to contact exposed areas along the portion of the path sufficiently as the strip is advanced to plate exposed areas with at least a minimum thickness of metal.

3. The method of claim 1, wherein the longitudinally extending portions of the strip are masked to expose the selected areas continuously along said portion of the path.

4. The method of claim 1, wherein the longitudinally extending portions of the strip are masked to expose the selected areas along segmented portions of said portion of the path.

5. The method of claim 1, which also includes the step of selectively masking a portion of said anode to provide a ratio of effective anodic area to expose areas of the strip which is in a predetermined range.

6. An apparatus for plating selected areas of surfaces of a strip, which define openings that extend through the strip between major surfaces thereof, which includes:

means for continuously advancing a strip along a path, said strip having two major surfaces and having openings which extend through the strip between said major surfaces;

means for cathodically charging the strip to a first potential;

means positioned along a portion of the path for masking longitudinally extending portions of the strip to expose only selected areas of surfaces of the strip, which include at least those surfaces that define the openings extending through the strip;

means, along said portion of the path, for establishing a substantially enclosed flow passage having an entry end and an exit end to direct an electroplating electrolyte through the openings in the strip, said flow passage including linear portions extending normal to the strip for a substantial distance from each major surface thereof;

an anode which is continuously charged to a second potential;

means for positioning said anode in a linear portion of the flow passage adjacent at least one major surface of the strip and extending parallel to the strip along said portion of the path, said anode being spaced from and focused on the exposed areas of the strip which define the openings; and means for flowing all of the electrolyte which enters the entry end of the flow passage continuously in one direction through the linear portion of the flow passage on one side of the strip, past the charged anode, through the openings in the strip and then along the linear portion on the opposite side of the strip to the exit end of the flow passage to cause an electric current to be passed through the electrolyte to electroplate the exposed areas of the strip.

7. The apparatus of claim 6, wherein a surface area of said anode is capable of being varied to provide a predetermined ratio of its surface area to that of the exposed areas of the strip.

8. The apparatus of claim 6, wherein said masking means is effective to expose the selected area of the strip continuously along said portion of the path.

9. The apparatus of claim 6, wherein said masking means is effective to expose the selected areas of the strip along segmented portions of said portion of the path.

10. An apparatus for plating selected portions of a metal strip having conductor-receiving slots spaced repetitively therealong which open to parallel major surfaces of the strip, which includes:

a housing through which the metal strip extends;

means within the housing for masking the strip, including at least portions of each of the major surfaces of the strip, to expose at least those surfaces of the strip or portions thereof which define the slots and for establishing a flow passage having an entry end and an exit end which extends in a direction through the slots and which has linear portions extending normal to the strip for a substantial distance from each major surface thereof;

means including at least one continuously charged, focused anode for establishing an electric field to electroplate the exposed portions of the strip, said means including means for charging the anode to a first potential and means for cathodically charging the strip to a second potential;

means for mounting each said continuously charged anode in a linear portion of the flow passage in alignment with the exposed portions of the strip;

means for continuously advancing the strip through the housing and past the anode;

means for flowing all of the electrolyte which enters the entry end of the flow passage continuously in one direction through the linear portion of the flow passage on one side of the strip, past each said charged anode through the openings in the strip to cause the electrolyte to be charged and an electric current to be passed therethrough and to flow the stream of the charged electrolyte through the flow passage over the surfaces in a direction through the slots and then along the linear portion on the opposite side of the strip to the exit end of the flow passage to electroplate at least those portions of the strip which define the openings; and means for controlling the flow velocity and pressure of the electrolyte which is flowed past the exposed surfaces of the strip and the aligned anode, said controlling means and said aligned anode being effective to cause the portions of the strip which define the slots to be plated with at least a minimum thickness of material.

11. The apparatus of claim 10, wherein the strip has a plurality of slots in rows extending parallel with a longitudinal centerline of the strip and the apparatus includes a plurality of anodes with each being aligned with one of the rows of slots and adjacent each major surface of the strip.

12. The apparatus of claim 11, wherein the anode is configured to provide a predetermined ratio of anodic-to-cathodic area.

* * * * *